US009850754B1

(12) United States Patent
Jiang et al.

(10) Patent No.: US 9,850,754 B1
(45) Date of Patent: Dec. 26, 2017

(54) HIGH SPEED TELEMETRY SIGNAL PROCESSING

(71) Applicant: GE Energy Oilfield Technology, Inc., Broussard, LA (US)

(72) Inventors: Yihan Jiang, Sugar Land, TX (US); Wilson Chun-Ling Chin, Oklahoma City, OK (US)

(73) Assignee: GE Energy Oilfield Technology, Inc., Broussard, LA (US)

( * ) Notice: Subject to any disclaimer, the term of this patent is extended or adjusted under 35 U.S.C. 154(b) by 0 days.

(21) Appl. No.: 15/185,221

(22) Filed: Jun. 17, 2016

(51) Int. Cl.
*G01V 3/00* (2006.01)
*E21B 47/18* (2012.01)

(52) U.S. Cl.
CPC ..... *E21B 47/18* (2013.01)

(58) Field of Classification Search
CPC . E21B 47/18; G07C 9/00087; G07C 9/00071; G07C 2009/00095
USPC ..... 367/83; 340/85.1, 854.1, 854.4; 381/4, 381/71.3, 310; 702/16, 85
See application file for complete search history.

(56) References Cited

U.S. PATENT DOCUMENTS 4,215,425 A 7/1980 Waggener
5,146,433 A 9/1992 Kosmala et al.
5,969,638 A 10/1999 Chin
6,308,562 B1 10/2001 Abdallah et al.
8,811,118 B2 8/2014 Reckmann
9,369,798 B1 * 6/2016 Alderson ..... H04R 3/002
2002/0180613 A1 * 12/2002 Shi ..... G01V 11/002 340/853.1
2003/0025639 A1 2/2003 Rodney
2003/0058148 A1 * 3/2003 Sheen ..... H03M 1/0626 341/155
2003/0202654 A1 * 10/2003 Xiong ..... H04M 9/082 379/406.01
2004/0003921 A1 1/2004 Schultz et al.
2004/0155794 A1 8/2004 Gardner
2006/0098531 A1 * 5/2006 Gardner ..... E21B 47/16 367/82
2009/0279476 A1 * 11/2009 Li ..... H04B 7/015 370/328

FOREIGN PATENT DOCUMENTS

GB 2361789 A 10/2001
WO WO 03/014525 A1 2/2003
WO WO 2014/025701 A1 2/2014

OTHER PUBLICATIONS

PCT Search Report and Written Opinion for PCT/US2017/036465; dated Aug. 14, 2017.

* cited by examiner

*Primary Examiner* — Dhaval Patel
(74) *Attorney, Agent, or Firm* — Crowe & Dunlevy, P.C.

(57) ABSTRACT

A drilling system includes a sensor, an encoder operably connected to the sensor and a pressure pulse generator operably connected to the encoder. The pressure pulse generator is configured to produce a primary signal in response to input from the encoder. The drilling system further includes a primary transducer, a reference transducer and a signal processor connected to the primary transducer and the reference transducer. The signal processor includes a two-stage filter that is configured to extract the primary signal from noise observed at the primary transducer.

20 Claims, 3 Drawing Sheets

HIGH SPEED TELEMETRY SIGNAL PROCESSING

FIELD OF THE INVENTION

This invention relates generally to the field of telemetry systems, and more particularly, but not by way of limitation, to signal processing systems for use in connection with acoustic signal generators deployed in wellbore drilling operations.

BACKGROUND

Wells are often drilled for the production of petroleum fluids from subterranean reservoirs. In many cases, a drill bit is connected to a drill string and rotated by a surface-based drilling rig. Drilling mud is circulated through the drill string to cool the bit as it cuts through the subterranean rock formations and to carry cuttings out of the wellbore.

As drilling technologies have improved, "measurement while drilling" techniques have been enabled that allow the driller to accurately identify the location of the drill string and bit and the conditions in the wellbore. MWD equipment often includes one or more sensors that detect an environmental condition or position and relay that information back to the driller at the surface. This information can be relayed to the surface using acoustic signals that carry encoded data about the measured condition.

Systems for emitting these acoustic signals make use of wave generators that create rapid changes in the pressure of the drilling mud. The rapid changes in pressure create pulses are carried through the drilling mud to receivers located at or near the surface. Pressure pulse generators include the use of rotary "mud sirens" and linearly-acting valves that interrupt the flow of mud through the pulse generator. The temporary flow disruption can be used to create a pattern of pressure pulses that can be recorded, interpreted and decoded at the surface.

The MWD signal is typically received by one or more transducers located on a standpipe on the surface. The MWD signals contain multiple frequencies and these signals may overlap with other sources of noise in the wellbore. Mud pumps and other drilling equipment may produce noise that frustrates the process of extracting the MWD signal. Additionally, as the MWD travels through the wellbore and standpipe, the MWD signal may reflect off of tubing and equipment (such as the mud pump). Depending on the signal strength, frequency and location of the recording transducers, the reflected signal may partially or entirely cancel the primary MWD signal. There is, therefore, a need for an improved method and system for recording MWD signals that alleviates the deficiencies experienced in the prior art.

SUMMARY

In various embodiments, the present invention includes a drilling system that includes a sensor, an encoder operably connected to the sensor and a pressure pulse generator operably connected to the encoder. The pressure pulse generator is configured to produce a primary signal in response to input from the encoder. The drilling system further includes a primary transducer, a reference transducer and a signal processor connected to the primary transducer and the reference transducer. The signal processor includes a two-stage filter that is configured to extract the primary signal from noise observed at the primary transducer.

In another embodiment, the present invention includes a receiver system for use in receiving and decoding a primary pressure pulse signal generated by a measurement-while-drilling (MWD) tool. The MWD tool can be used in a drilling system that includes a mud pump that is a source of pressure pulse signal noise. The receiver system includes a primary transducer, a reference transducer and a signal processor. The primary transducer produces an electric signal in response to the measurement of the primary pressure pulse signal and the pressure pulse signal noise. The reference transducer produces an electric signal in response to the measurement primarily of the pressure pulse signal noise.

The signal processor includes an adaptive filter and a low pass filter. The adaptive filter produces a first-filtered electric signal from the electric signals produced by the primary transducer and reference transducer. The low pass filter produces a second-filtered electric signal from the first filtered-electric signal. The second-filtered electric signal represents the recovered primary signal.

In another aspect, the present invention includes a method for processing a primary pressure pulse signal generated by a measurement-while-drilling (MWD) tool that is used in a drilling system. The method begins with the steps of producing a reference electric signal in response to the measurement primarily of the pressure pulse signal noise and producing a primary electric signal in response to the measurement of the primary pressure pulse signal and the pressure pulse signal noise. The method continues with the step of applying an adaptive filter to the reference electric signal and the primary electric signal to produce a first-filtered electric signal. Next, the method includes the step of applying a low pass filter to the first-filtered electric signal to produce a second-filtered electric signal. The method continues with the step of decoding the primary electric signal from the second-filtered electric signal.

WRITTEN DESCRIPTION

Figure 1:
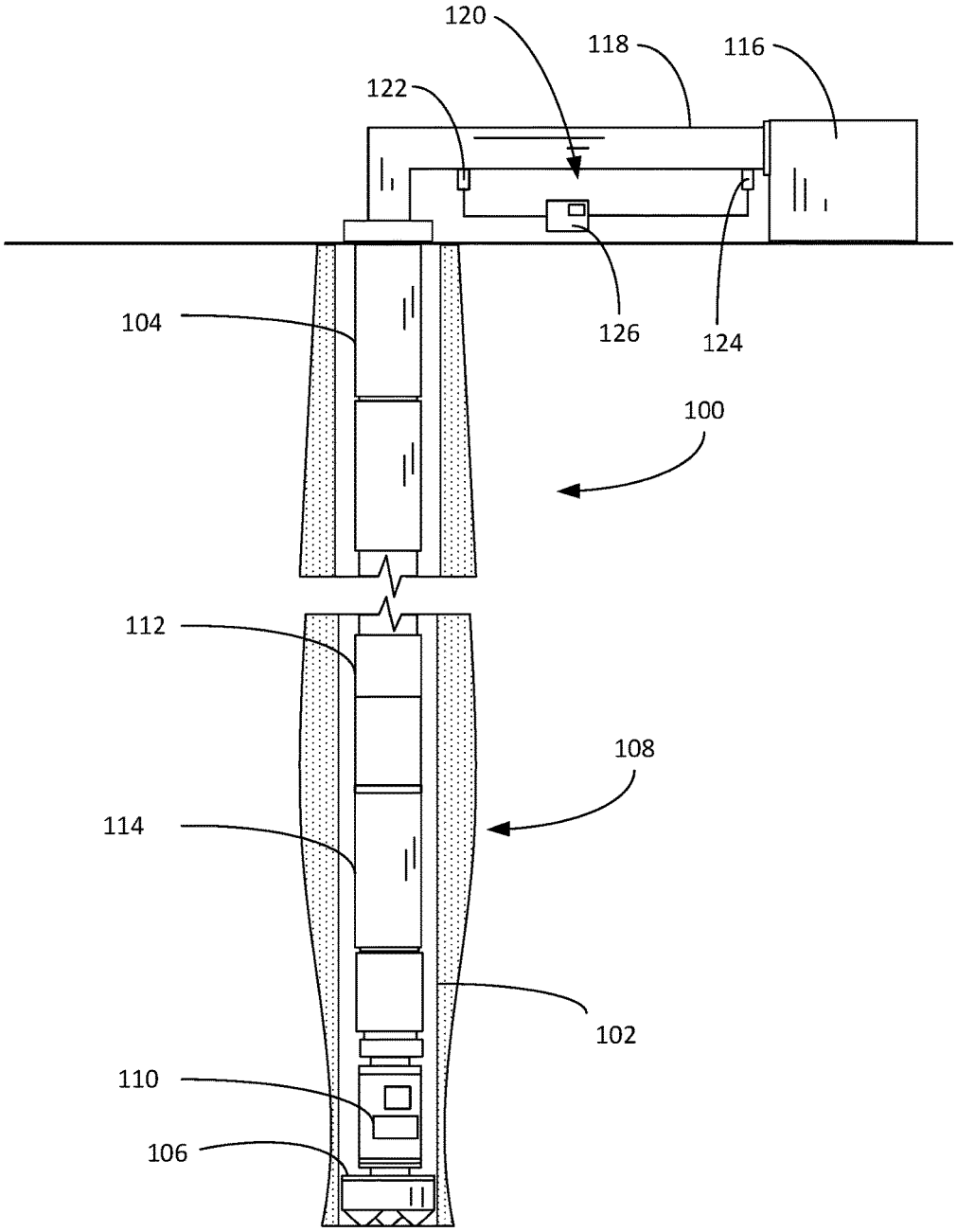
FIG. 1 is an elevational view of a drilling system constructed in accordance with an embodiment of the present invention.

In accordance with an embodiment of the present invention, FIG. 1 shows a drilling system 100 in a wellbore 102. The drilling system 100 includes a drill string 104, a drill bit 106 and a MWD (measurement while drilling) tool 108. It will be appreciated that the drilling system 100 will include additional components, including drilling rigs, mud pumps and other surface-based facilities and downhole equipment. Although the embodiments of the present invention are disclosed in connection with a measurement-while-drilling (MWD) tool 108, it will be appreciated that the present invention will also find utility in logging-while-drilling (LWD) techniques. Accordingly, references to MWD should be understood to broadly refer to any applications or techniques that involve the use of pressure pulse signal telemetry from the wellbore 102.

The MWD tool 108 includes one or more sensors 110, an encoder module 112 and a pressure pulse generator 114. It will be appreciated that the MWD tool 108 may include additional components, such as centralizers. The sensors 110 are configured to measure a condition on the drilling system 100 or in the wellbore 102 and produce a representative signal for the measurement. Such measurements may include, for example, temperature, pressure, vibration, torque, inclination, magnetic direction and position. The signals from the sensors 110 are encoded by the encoder module 112 into command signals delivered to the pressure pulse generator 114.

Pressurized drilling mud is provided to the drilling system 100 by a mud pump 116 through a standpipe 118. The standpipe 118 and mud pump 116 may be located on the surface or below the platform of a drilling rig. Based on the command signals from the encoder module 112, the pressure pulse generator 114 controllably adjusts the flow of drilling mud or other fluid through the pressure pulse generator 114. The rapid variation in the size of the flow path through the pressure pulse generator 114 increases and decreases the pressure of drilling mud flowing through the MWD tool 108. The variation in pressure creates acoustic pulses that include the encoded signals from the sensors 110.

The original signal generated by the pressure pulse generator 114 is referred to herein as the "primary" signal. Extraneous noise within the wellbore 102 and standpipe 118 is referred to herein as "noise." Noise includes pressure pulses generated by equipment other than the pressure pulse generator 114, environmentally-produced pulses and reflections from the primary signal. The primary signals and noise are transmitted through drilling mud, equipment and tubing in the wellbore 102 and standpipe 118.

A receiver system 120 records the pressure pulses within the standpipe and isolates the primary signal from the noise. In exemplary embodiments, the receiver system 120 includes a primary transducer 122, a reference transducer 124 and a signal processor 126. The reference transducer 124 is positioned in the standpipe 118 in relative close proximity to the mud pump 116. In this position, the noise created by the mud pump 116 dominates the pressure pulses recorded by the reference transducer 124. In this location, the reference transducer 124 is therefore configured to produce an electric signal that is largely reflective of the noise created by the mud pump 116 and noise reflected off the mud pump 116.

The primary transducer 122 is positioned within the standpipe at a spaced-apart distance from the mud pump 116 and reference transducer 124. The primary transducer 122 is positioned within the standpipe 118 at a location which minimizes the extent of reflected signals. The primary transducer 122 is configured to produce an electric signal that is responsive to the measurement of the primary signal and noise within the standpipe 118.

The signals produced by the primary transducer 122 and reference transducer 124 are provided to the signal processor 126. Although the signal processor 126 is depicted as a standalone component, it will be appreciated that the signal processor 126 can be incorporated within a computer or computer network used in conjunction with the drilling or logging process. Generally, the signal processor 126 is configured to extract and isolate the primary signal from the noise in the standpipe 118 and wellbore 102 in real-time with little or no delay. Effective and rapid isolation of the primary signal from the noise enlarges the bandwidth of the telemetry from the MWD tool 108 to the surface and permits the transmission of a primary signal with increased spectral density.

Figure 2:
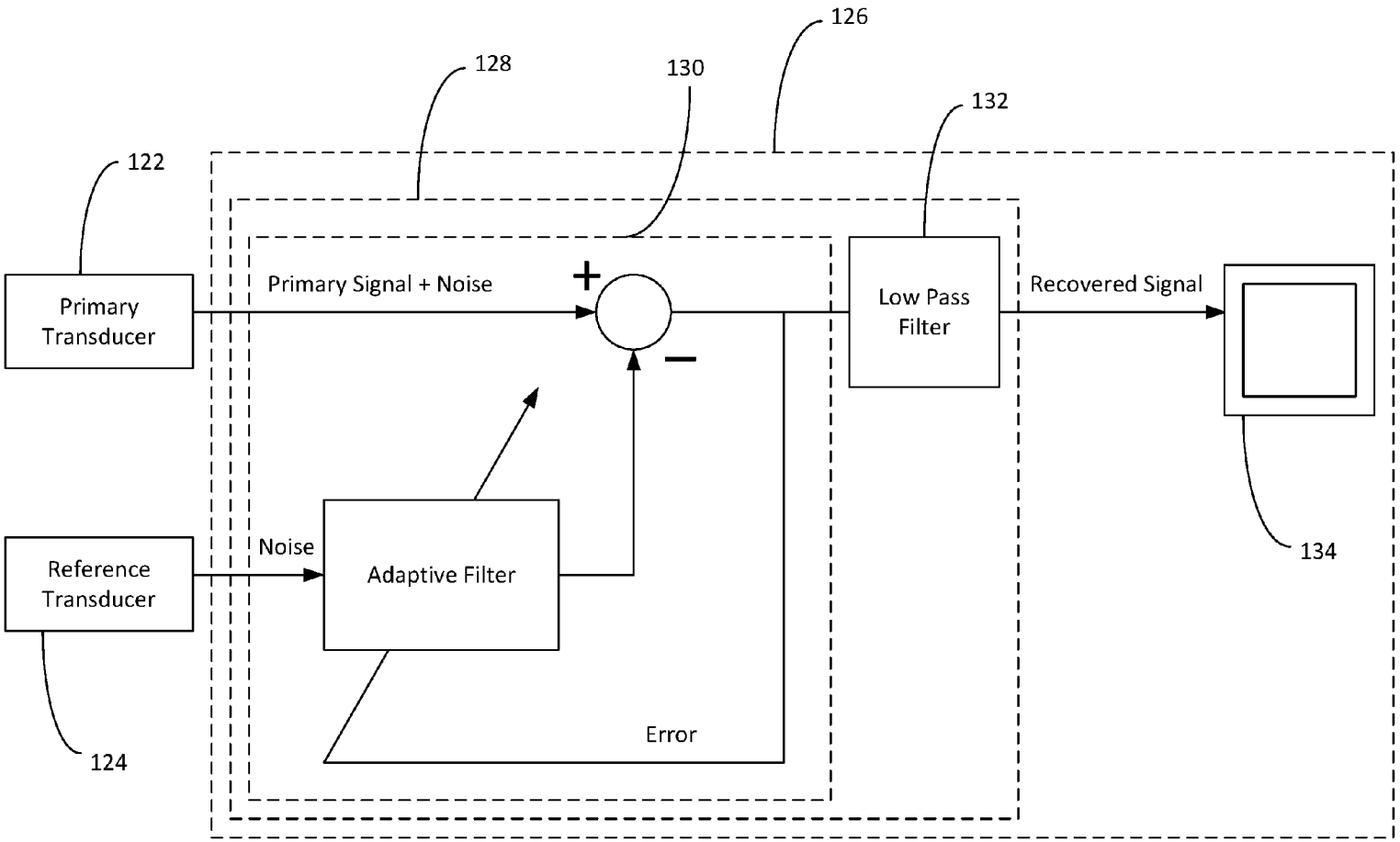
FIG. 2 is a diagrammatic depiction of the MWD signal processor of the present invention.

Turning to FIG. 2, shown therein is a diagrammatic depiction of a two-stage filter 128 used to extract the primary signal from the combination of the primary signal and noise. The two-stage filter 128 is incorporated as a computer program running within the signal processor 126. In the first stage, the output from the primary transducer 122 and reference transducer 124 are fed into an adaptive filter 130. The adaptive filter 130 produces a first-filtered electric signal. In the second stage, the output from the adaptive filter 130 is provided to a low pass filter 132. The low pass filter 132 produces a second-filtered electric signal that represents the recovered primary signal. The recovered primary signal is provided by the low pass filter 132 to a display 134 or other output device for displaying the recovered signal to an operator or for sending the recovered signal to automated controls associated with the drilling process.

In exemplary embodiments, the adaptive filter 130 is a least means squares (LMS) adaptive filter. The adaptive filter has a step size of from about 0.0001 to about 0.00001 and a filter length of from about 500 to about 10,000. These values are selected to provide rapid and reliable convergence within the adaptive filter 130. In some embodiments, the adaptive filter 130 has a step size of about 0.00003 and a filter length of about 5000. These settings can be adjusted by the operator or automatically by the signal processor 126 in response to convergence or divergence results. The adaptive filter 130 uses the reference signal provided primarily by the reference transducer 124 to remove noise from the signal provided by the primary transducer 122.

The signal extracted by the adaptive filter 130 is presented to the low pass filter 132, where high frequency noise is reduced. In exemplary embodiments, the low pass filter 132 is a finite impulse response (FIR) filter that is configured to permit passage of only the lower frequency signals associated with the known spectra of the primary signal generated by the MWD tool 108. In other embodiments, the low pass filter is a Hamming window FIR filter or a Kaiser window FIR filter. The output of the low pass filter 132 represents the recovered primary signal, which can be presented to a decoder module 134. The decoder module 134 is configured to decode the data from the recovered primary signal. It will be appreciated that displays, control systems or other peripherals can be connected to the signal processor 126 for the purpose of displaying, storing or utilizing the processed signals.

Figure 3:
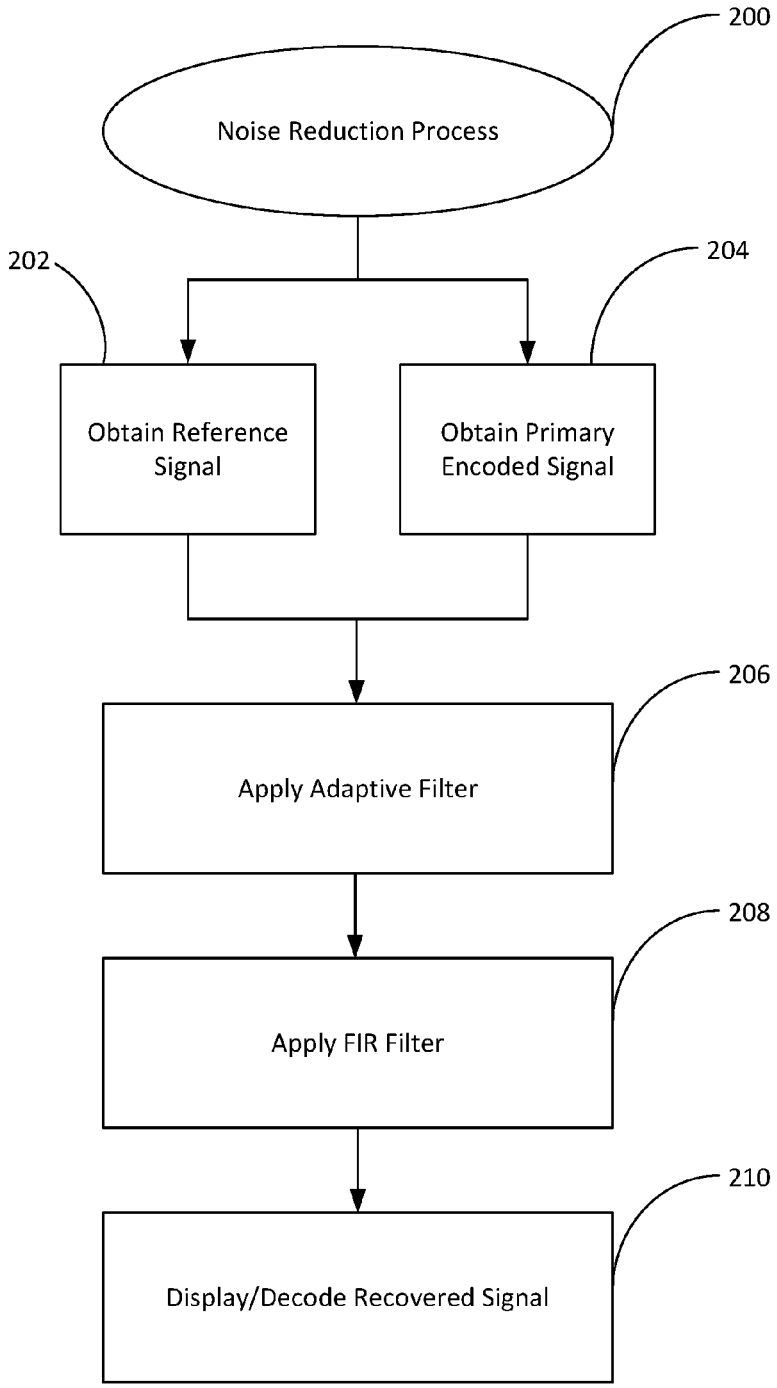
FIG. 3 is a process flow diagram depicting a method of processing the MWD signal.

Turning to FIG. 3, shown therein is a process flow diagram for a method 200 of reducing noise from a signal generated by the MWD tool 108. The process begins at steps 202 and 204, which may take place simultaneously or in sequence. At step 202, a reference electric signal is obtained by the signal processor 126. In exemplary embodiments, the step of obtaining the reference electric signal includes the steps of positioning the reference transducer 124 in close proximity to the mud pump 116 and generating the reference electric signal that is representative of the pressure pulses produced by, and reflected from, the mud pump 116.

At step 204, a primary electric signal is obtained by the signal processor 126. The step 204 of obtaining the primary electric signal includes positioning the primary transducer 122 at a spaced-apart distance from the reference transducer 124 and generating the primary electric signal that is representative of the pressure pulses measured by the primary transducer 122. The primary transducer 122 is placed at a location within the wellbore 102 or standpipe 118 that minimizes the ratio of noise to the primary signal produced by the MWD tool 108.

The process continues at step 206, during which the adaptive filter 130 is applied by the signal processor 126 to the output of the primary transducer 122 and reference transducer 124 to produce a first-filtered electric signal. The adaptive filter 130 can be a least means squared (LMS) adaptive filter. The step 206 of applying the adaptive filter 130 may include applying an LMS adaptive filter with a step size of about 0.00003 for a filter length of about 5000. The step 206 of applying the adaptive filter 130 generally uses the reference signal as a basis for removing noise associated with the mud pump 116 from the signal produced by the primary transducer 122.

Next, at step 208, the output from the adaptive filter 130 is routed through a low pass filter 132 to produce a second-filtered electric signal. The low pass filter 132 is configured to remove higher frequency signals that are not associated with the primary signal produced by the MWD tool 108. The low pass filter 132 can be a finite impulse response (FIR) low pass filter. Finally, at step 210, the second-filtered electric signal is sent from the two-stage filter 128 to downstream processing where the extracted primary signal is decoded, displayed and used as a basis for reviewing the measurements made by the MWD tool 108.

Thus, in exemplary embodiments, the present invention provides a system and method for extracting a primary encoded signal produced by the MWD tool 108 from noise present in the wellbore 102 and standpipe 118. The use of the two-stage filter 128 in combination with the strategically located primary transducer 122 and reference transducer 124 presents a significant advancement over prior art signal processing systems. It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A drilling system including a mud pump comprising:
- a sensor;
- an encoder operably connected to the sensor;
- a pressure pulse generator operably connected to the encoder, wherein the pressure pulse generator is configured to produce a primary signal in response to input from the encoder;
- a primary transducer configured to produce a primary transducer signal in response to a measurement of the primary signal;
- a reference transducer configured to produce a reference transducer signal in response to a reflection of the primary signal off the mud pump; and
- a signal processor connected to the primary transducer and the reference transducer, wherein the signal processor comprises a two-stage filter that is configured to extract the primary signal from the primary transducer signal and the reference transducer signal observed at the primary transducer.

2. The drilling system of claim 1, wherein the the reference transducer is positioned in close proximity to the mud pump.

3. The drilling system of claim 2, wherein the primary transducer is positioned in a spaced-apart relationship with the reference transducer.

4. The drilling system of claim 3, wherein the two-stage filter comprises:
- an adaptive filter; and
- a low pass filter configured to receive the output from the adaptive filter.

5. The drilling system of claim 4, wherein the adaptive filter receives the reference transducer signal from the reference transducer.

6. The drilling system of claim 5, wherein the adaptive filter is a least means square adaptive filter.

7. The drilling system of claim 6, wherein the adaptive filter has a step size of about 0.00003 and a filter length of about 5000.

8. The drilling system of claim 4, wherein the low pass filter is selected from the group consisting of Hamming window finite impulse response filters and Kaiser window finite impulse response filters.

9. The drilling system of claim 4, further comprising a decoder module that is configured to decode the output from the low pass filter.

10. A receiver system for use in receiving and decoding a primary pressure pulse signal generated by a measurement-while-drilling (MWD) tool used in a drilling system that includes a mud pump that is a source of pressure pulse signal noise caused by the reflection of the primary pressure pulse signal off of the mud pump, the receiver system comprising:
- a primary transducer, wherein the primary transducer produces an electric signal in response to the measurement of the primary pressure pulse signal and the pressure pulse signal noise caused by the reflection of the primary signal off the mud pump;
- a reference transducer, wherein the reference transducer produces an electric signal in response to the measurement primarily of the pressure pulse signal noise caused by the reflection of the primary signal off the mud pump; and
- a signal processor, wherein the signal processor comprises:
  - an adaptive filter, wherein the adaptive filter produces a first-filtered electric signal from the electric signals produced by the primary transducer and reference transducer; and
  - a low pass filter, wherein the low pass filter produces a second-filtered electric signal from the first filtered-electric signal.

11. The receiver system of claim 10, wherein the reference transducer is positioned in close proximity to the mud pump.

12. The receiver system of claim 11, wherein the primary transducer is positioned in a spaced-apart relationship with the reference transducer.

13. The receiver system of claim 10, wherein the adaptive filter is a least means square adaptive filter.

14. The receiver system of claim 13, wherein the adaptive filter has a step size of from about 0.0001 to about 0.00001 and a filter length of from about 500 to about 10,000.

15. The receiver system of claim 10, wherein the low pass filter is a finite impulse response filter.

16. The receiver system of claim 10, further comprising a decoder module that is configured to decode the second-filtered electric signal from the low pass filter.

17. A method for processing a primary pressure pulse signal generated by a measurement-while-drilling (MWD) tool used in a drilling system that includes a mud pump that is a source of pressure pulse signal noise caused by the reflection of the primary pressure pulse signal off of the mud pump, the method comprising the steps of:

producing a reference electric signal, wherein the reference electric signal is produced in response to the measurement primarily of the pressure pulse signal noise caused by the reflection of the primary pressure pulse signal off of the mud pump;

producing a primary electric signal, wherein the primary electric signal is produced in response to the measurement of the primary pressure pulse signal and the pressure pulse signal noise caused by the reflection of the primary pressure pulse signal off of the mud pump;

applying an adaptive filter to the reference electric signal and the primary electric signal to produce a first-filtered electric signal;

applying a low pass filter to the first-filtered electric signal to produce a second-filtered electric signal; and decoding the primary electric signal from the second-filtered electric signal.

18. The method of claim 17, wherein the step of producing a reference electric signal further comprises the step of positioning a reference transducer in close proximity to the mud pump.

19. The method of claim 17, wherein the step of applying an adaptive filter further comprises applying a least means squared adaptive filter.

20. The method of claim 19, wherein the step of applying a least means squared adaptive filter further comprises applying a least means squared adaptive filter with a step size of from about 0.001 to about 0.0001 for a filter length of from about 500 to about 10,000.

* * * * *